US005752376A

United States Patent [19]

Vittorio et al.

[11] Patent Number: 5,752,376

[45] Date of Patent: May 19, 1998

[54] TENSION-REGULATING ROTARY UNWINDER FOR A DOUBLE-TWIST TWISTING FRAME

[75] Inventors: Colussi Vittorio, Cappella Maggiore; Gardin Giovanni, Zoppola; Badiali Roberto, Pordenone, all of Italy

[73] Assignee: Savio Macchine Tessili S.p.A., Pordenone, Italy

[21] Appl. No.: 790,191

[22] Filed: Jan. 30, 1997

[30] Foreign Application Priority Data

Feb. 5, 1996 [IT] Italy ..... MI96A0204

[51] Int. Cl.[6] ..... D01H 1/10

[52] U.S. Cl. ..... 57/58.83; 57/58.86

[58] Field of Search ..... 57/58.83, 58.49, 57/58.7, 58.84, 58.86, 80, 352, 353, 354

[56] References Cited

U.S. PATENT DOCUMENTS

| | | | |
|---|---|---|---|
| 2,638,732 | 5/1953 | Sabaton | 57/58.83 |
| 3,284,024 | 11/1966 | Franzen | 242/128 |
| 3,296,788 | 1/1967 | Franzen | 57/58.83 |
| 3,975,893 | 8/1976 | Franzen | 57/354 X |
| 4,114,357 | 9/1978 | Greive | 57/354 X |
| 4,423,587 | 1/1984 | Inoue | 57/58.83 X |
| 4,928,463 | 5/1990 | Frentzel-Beyme | 57/58.83 X |
| 4,959,951 | 10/1990 | Mori | 57/58.52 |
| 5,291,729 | 3/1994 | Badiali et al. | 57/279 |
| 5,456,070 | 10/1995 | Lin et al. | 57/58.83 X |
| 5,497,607 | 3/1996 | Branson | 57/58.83 X |

FOREIGN PATENT DOCUMENTS

| | | | |
|---|---|---|---|
| 417850 | 3/1991 | European Pat. Off. . | |
| 3318893 | 12/1984 | Germany | 57/352 |
| 39 16 969 | 11/1989 | Germany . | |
| 403287823 | 12/1991 | Japan | 57/58.83 |
| 419929 | 8/1966 | Switzerland . | |
| 753354 | 7/1956 | United Kingdom | 57/58.83 |
| 864716 | 4/1961 | United Kingdom | 57/352 |
| 2 062 698 | 5/1981 | United Kingdom . | |

OTHER PUBLICATIONS

Patent Abstracts of Japan vol. 14, No. 202, Apr. 25, 1990 and JP 02 041418, Feb. 9, 1990 (Abstract).

*Primary Examiner*—C. D. Crowder
*Assistant Examiner*—Tina R. Taylor
*Attorney, Agent, or Firm*—Rogers & Wells LLP; George P. Hoare

[57] ABSTRACT

A device for regulating and controlling the unwinding tension in a double-twist twisting frame, having a member which is mounted coaxially, in an idle and rotatable manner, on the respective pin of the unwinding packages. The device is provided with elastic yieldable elements which project radially from the pin to engage unwound yarn during the depletion stage of the feed packages.

6 Claims, 3 Drawing Sheets

TENSION-REGULATING ROTARY UNWINDER FOR A DOUBLE-TWIST TWISTING FRAME

This invention relates to a double-twist twisting frame, and more specifically to the control of the tension in the yarns fed to the twisting frame.

The twisting operation generally is the binding together two or more yarns by twisting them together about their longitudinal axis. This operation results in a ply yarn of higher quality, more resistant to tension and abrasion, more regular and of improved appearance and feel.

Twisting can be conducted either by feeding two or more yarns which already have been coupled together and wound parallel to one another by a coupler, or by withdrawing the individual yarns from two separate, generally conical superposed packages. The present invention can be advantageously applied to both types of twisting, however, to allow a better understanding of the technical problems of twisting, and of the characteristics and advantages of the technical solution according to the present invention, it is described hereinafter with reference to a twisting frame fed with separate yarns from two overlying packages, of the type forming the subject of the previous patents EP-A-417,850 and U.S. Pat. No. 5,291,729 of the present applicant, to which reference should be made for greater details of the overall twisting frame.

Figure 1:
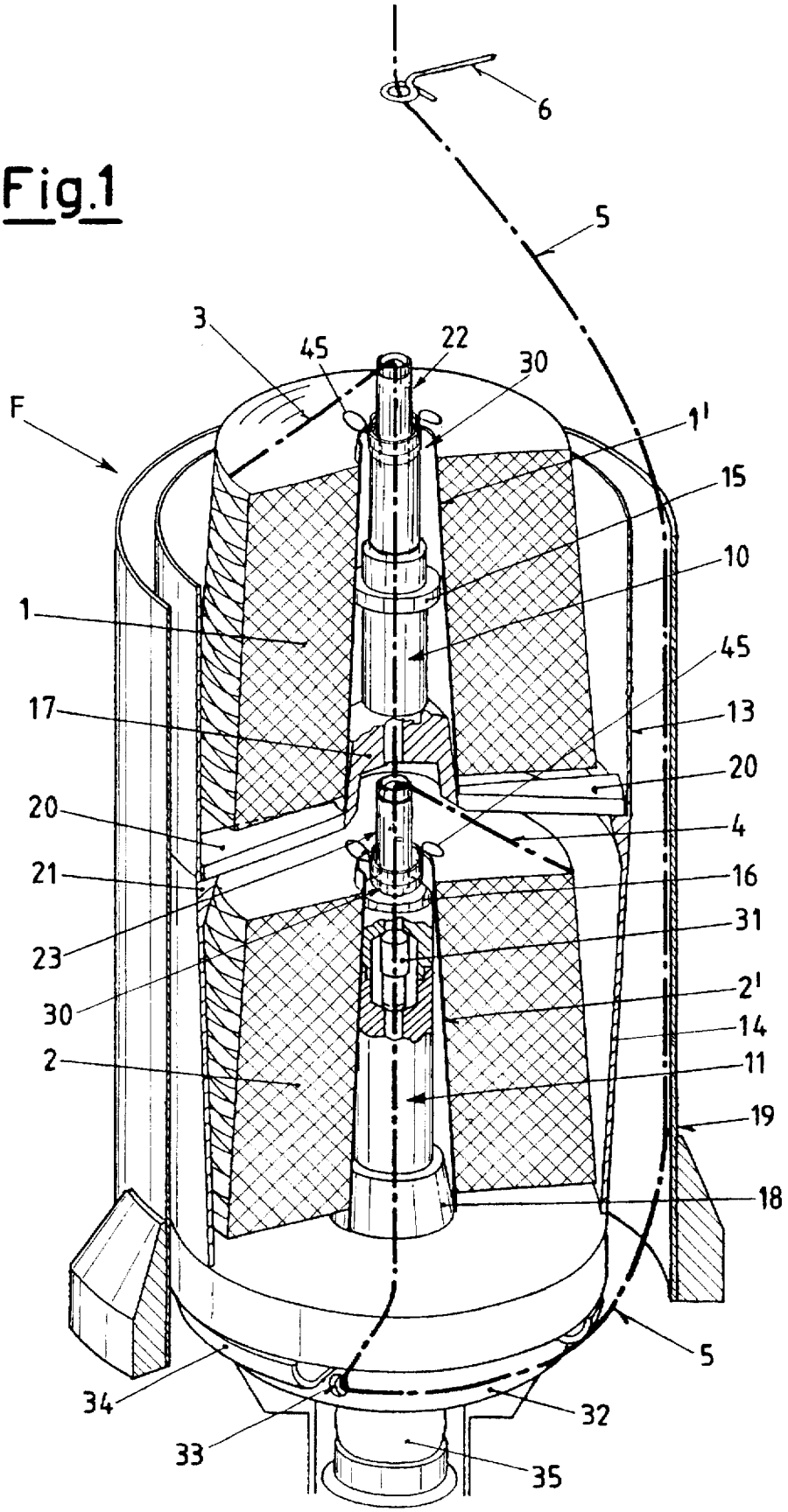
Figure 3:
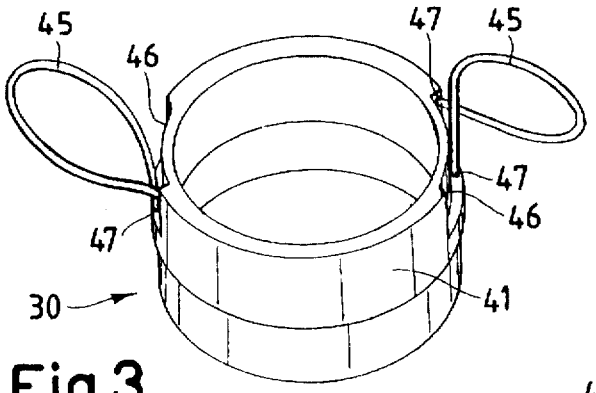
Figure 2:
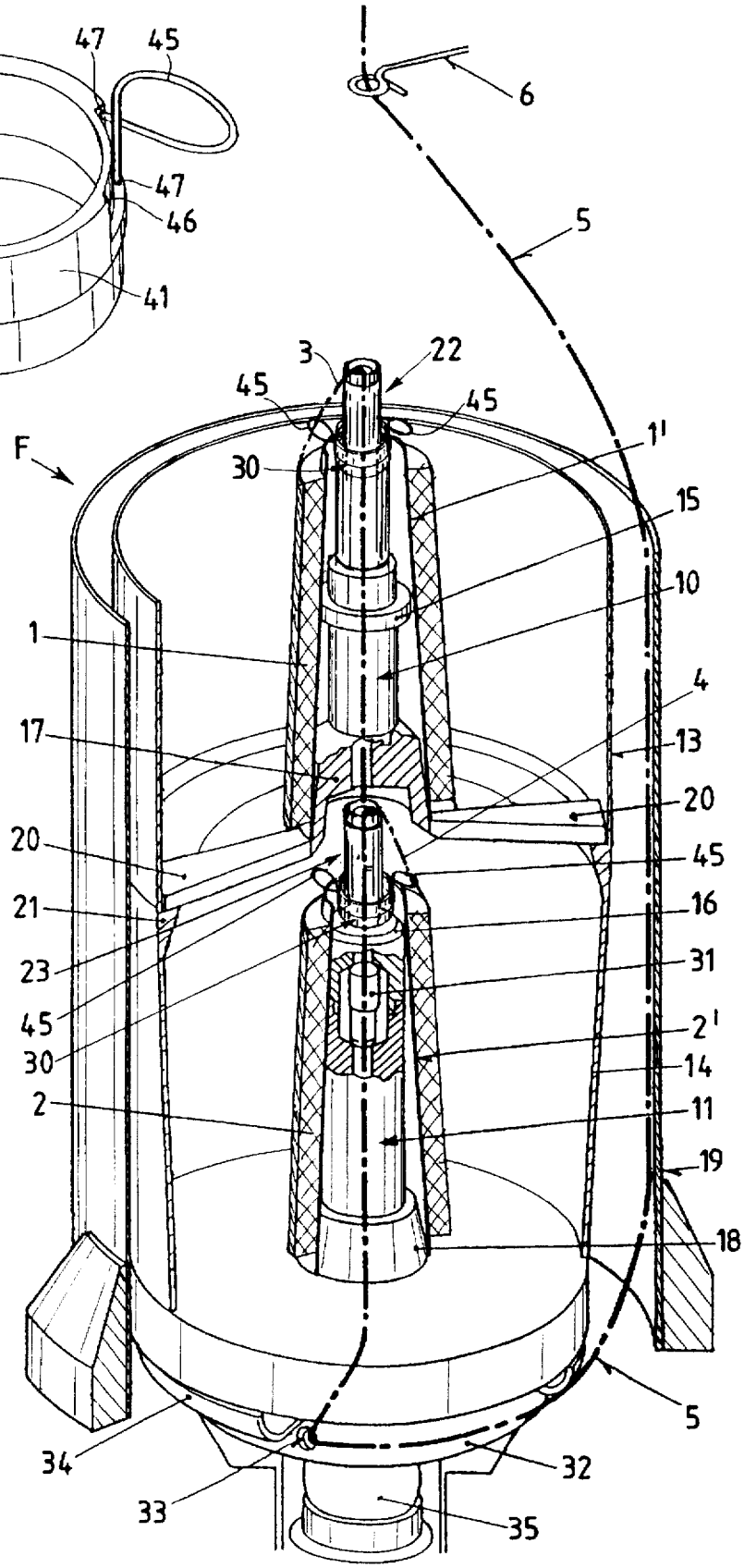
Figure 4:
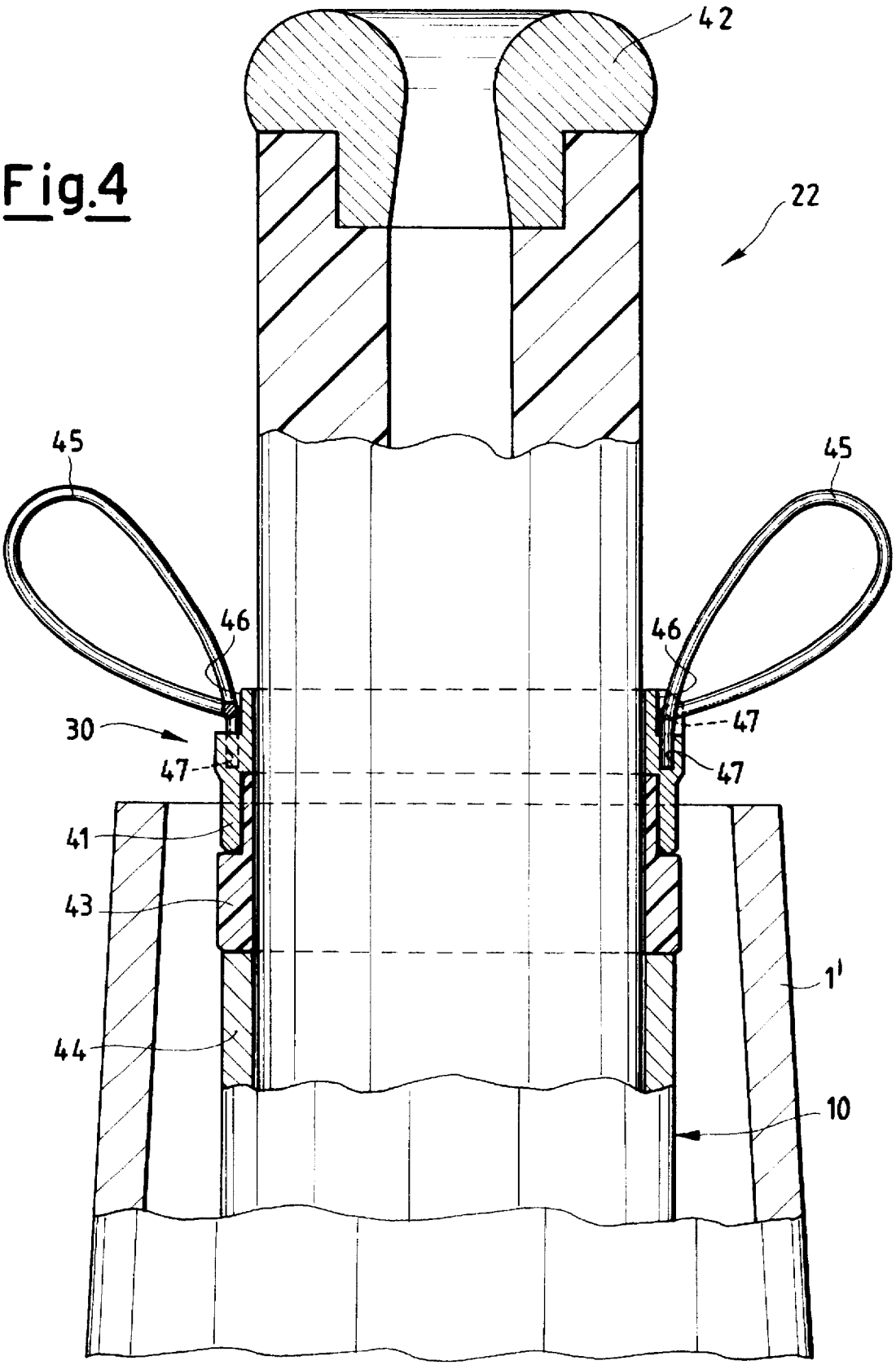

Generally, double-twist twisting frames have a plurality of twisting stations arranged side by side along the machine face or faces. The ensuing description relatives to a single twisting station. FIG. 1 is a perspective view of the twisting spindle F of a twisting station with the feed packages shown in the initial stage of their unwinding, and FIG. 2 illustrates when the unwinding operation is nearly complete. FIGS. 3 and 4 show an embodiment of the device for controlling the tension in the unwinding yarns.

The feed is provided from the upper feed package 1 and the lower feed package 2 by the yarns 3 and 4, respectively, which form the double twisted yarn 5 representing the product of the twisting station. The twisted yarn 5 passes through a thread guide ring 6 and proceeds towards the twisted product yarn collection bobbin, not shown for simplicity. The rotational speed of this bobbin is maintained constant and determines the linear unwinding speed of the underlying feed packages 1 and 2. The production rate is of the order of some tens of linear meters of twisted yarn per minute.

The frusto-conical packages 1 and 2 positioned tapering upwardly, are centered by respective overlying hollow pins 10, 11 forming the core of the twisting spindle, and are contained in two baskets 13, 14, respectively. The pins 10 and 11 are provided with circumferential enlargements 15, 16, respectively, which together with the lower hubs 17 and 18 act as support and centering elements for the unwinding packages 1 and 2, or more specifically for their tubes 1' and 2' respectively. The twisting station is contained within an outer casing 19 currently known as the balloon container.

The upper hub 17 is supported by radial support elements 20 which are connected to the basket 13. A suitable enlargement 21 on the upper edge of the underlying basket 14 supports and centres the upper basket 13.

At the top 22, 23 of each of the two coaxial superposed pins 10, 11 forming the core of the twisting spindle, there is located the device 30 for regulating and controlling the unwinding tension of the packages, this being an important characteristic of the present invention and being described hereinafter in greater detail in terms of its constituent parts shown in FIGS. 3 and 4. The two yarns 3 and 4 enter the cavity in the respective pins 10 and 11 and jointly pass through it as far as the foot of the twisting station, to encounter a tensioning device 31 within the spindle, already known in the art in various constructions. At the foot of the twisting station there is positioned a rotary disc 32, which is provided with a radial duct 33 from which there emerges the double yarn 5, and with an edge 34 which guides the yarn after it emerges.

The rotary disc 32 is the only driven part of the twisting spindle F, it being rotated by the pulley 35 driven by a belt not shown in the figure, or by other operating means known in the art.

The technical problem confronted by the present invention derives from the fact that the feed yarns are unwound with a resistance, and hence a tension, which varies during the course of the unwinding and tends to decrease as the diameter of the unwound packages decreases. The variation in the unwinding resistance is due not only to the variation in the angular and linear unwinding velocities with respect to the package deriving from the helical to-and-fro movement of the yarn along the conical package (the point at which the yarn leaves the package axially and radially approaches and withdraws from the point at which the yarn leaves at substantially constant velocity), but also to the inevitable imperfections of the yarn and of its winding into packages, to the so-called liveliness of the yarn, and finally to the difference in the yarn path as the package gradually decreases in diameter. When the feed package is in the initial stage, as shown in FIG. 1, the yarn unwinds from the frusto-conical package surface, slides along it for a significant length and within this length undergoes a braking action which prevails over the other three aforesaid actions, to hence obtain a resistance to unwinding and an unwinding tension which are significantly regular. When however the package unwinding is nearing termination, as shown in the configuration of FIG. 2, the yarn path becomes nearly vertical, and the yarn separates from the frusto-conical surface without significantly sliding along it. The unwinding tension becomes much more irregular and the possible other irregularities during unwinding become prevalent. In this respect, the twisted yarn can comprise loops, spirals or rings where variations in unwinding resistance arise, particularly in the case of lively yarns. Under these circumstances the feed yarns are no longer correctly coupled together with coherent lengths and the resultant product yarn is defective and unacceptable, taking account of the fact that the product of a twisting operation is supposed to be yarn of the highest quality. The technical problem confronted is therefore to achieve a more regular and predetermined package unwinding tension during the final stages of their unwinding. As already stated, the device 30 for regulating and controlling the package unwinding tension forms a characteristic and important part of the present invention, and is described with reference to a typical embodiment thereof illustrated in FIGS. 3 and 4 by way of non-limiting example.

The unwinding tension regulating device 30 has an idle collar 41 to be mounted coaxially on the pins 10, 11, at their tops 22, 23 just below their upper metal endpiece 42, which has smooth chamfered surfaces to limit friction against the yarn which slides and rotates on it. According to a preferred embodiment of the invention the collar 41 is cylindrical and constructed of easily machined lightweight metal, such as aluminium or its alloys, and has an inner diameter substantially larger than that of the parts 22, 23 of the pins 10, 11 on which it is mounted, so that there is no slippage and wear either of the collar 41 or of the parts 22, 23. Below said collar 41 there is mounted a second yarn collar 43, coaxial with the collar 41 and preferably constructed of a polymer plastic of low friction coefficient.

The collar 43 is rigidly connected to the collar 41 so that they rotate together about their pivots 22, 23. The collar 43 is supported by a fixed shoulder 44 rigid with the pin 10, 11 so that a rotary force exerted on the collar 41 causes the idle pair of collars 41 and 43 to rotate about the shoulder 44 and pin 10, 11, with the plastic material of the collar 43 sliding against them, and not the metal of the collar 41.

On the collar 41 there are provided two or more closed loop elements 45 projecting radially from the collar and formed of a flexible elastic material, for example monofilaments of polyamide polymers, such as nylon, or polymers of equivalent mechanical characteristics, or of spring steel wire of small cross-section. The radial dimension of the projecting elements 45 is of the order of 10–30 mm, their yieldability being such as not to offer significant resistance to the positioning and removal of the packages 1, 2 in and from their basket 13, 14 but to return to their projecting position without damage after such handling. The level at which the collar 41 is positioned on the pins 10, 11 enables the loops 45 to project radially well above the top of the tubes 1' and 2' of the packages 1 and 2 being unwound.

In the embodiment shown in FIGS. 3 and 4 the loops 45 are fixed by holes provided in recesses 46 formed in the outer face of the upper end of the collar 41. The holes 47 are preferably mutually perpendicular, the natural rigidity of the filament 45 resulting in the projecting configuration in the radial direction shown in the figures. The ends of the monofilaments forming the loop 45 are inserted into the holes 47, after which the parallel faces of the metal parts comprising the holes are compressed to lock the ends of said loops 45 by deformation of the holes. In a modified embodiment of the invention the pair of collars 41 and 43 can then be locked axially by applying a coaxial elastic ring above the collar 41 after it has been mounted in position on the pin 10, 11. Essentially, the unwinding device 30 has a member coaxial with the pins 10, 11, which is mounted idly and rotatably on them and is provided with yieldable elastic elements 45 which project radially from the pin so as to make contact with the unwound yarns 3, 4 when the feed packages are nearing depletion, at which stage the yarns follow an approximately vertical path which does not allow them to significantly slide along the outer surface of the package.

During the unwinding of the underlying packages the tension regulating device 30 acts in the following manner. In the configuration of FIG. 1, which corresponds to the initial stage of unwinding of the packages, it can be seen that the yarns 3 and 4 pass nearly horizontally and well taut above their tension regulator 30. The sliding along the package is sufficient to provide regular tension to the yarn. In this situation the regulator is not involved and remains at rest without rotating and with its loops 45 inoperative. In the configuration of FIG. 2, corresponding to nearly depleted packages, the yarns 3 and 4 reach the top of their hollow pins 10 and 11 and the endpiece 42 along a nearly vertical path, and during rotation intersect the position of the loops 45.

As soon as the rotating yarn 3, 4 encounters one of the loops 45 of its unwinding device 30 and of its idle collars 41, 43, it hooks onto it and drags it into rotation with it to hence create an additional resistance to unwinding. This resistance is weak but has surprisingly been found sufficient to regularize the unwinding tension and to eliminate the causes of the twisted yarn spirals or rings due to loose coupling of the yarns, even in the case of lively yarns. The yieldability of the restraint represented by the yieldable loops 45 creates a certain small "yarn reserve" and ensures that any increase in the resistance to unwinding of the yarn 3, 4 due to irregular winding results in deformation of the loop, with disengagement and release of the engaged yarn, only to again encounter and engage it after a fraction of a revolution, after the tension has become regular. This device is therefore also useful in reducing possible yarn breakage due to unwinding irregularities, as it attenuates the tension variations in the yarn.

What is claimed is:

1. A double-twist twisting frame in which yarns to be twisted together are withdrawn from packages located in a centered manner on vertical hollow pins into which the withdrawn yarns enter at the top and slide downwards through the pins to a twisting station therebelow wherein the yarns are twisted and from which the twisted yarns are passed to a collection bobbin, said frame comprising: a tension regulator for packages nearing depletion including a collar device coaxial with each of the pins, wherein each of said collar devices is idly mounted on and rotatable with a pin, and a plurality of elastic closed loop members about and projecting radially from and above said collar device, wherein each of said loop members has a pair of ends secured to said collar device, wherein each of said elastic loop members is yieldable to allow the changing of full and depleted packages to and from the pin upon which said collar device is mounted, and wherein each of said loop members can make contact with and provide tension on the yarn as the yarn is being unwound from a package nearing depletion.

2. The frame of claim 1, wherein said collar device includes an upper collar to which said ends of said elastic closed loop members are secured and a lower collar rigidly secured to said upper collar, wherein said lower collar is slidable on a pin as said collar device rotates thereon.

3. The frame of claim 2, wherein each of said upper collars has a diameter which is larger than the diameter of the adjacent portions of each of the pins.

4. The frame of claim 1, wherein said upper collar has holes therein for receiving said ends of each of said elastic closed loop members, and wherein said upper collar about said holes is deformable to lock said ends therein.

5. The frame of claim 1, wherein said elastic closed loop members are formed from at least one member from the group consisting of polymers and yieldable spring steel wire.

6. The frame of claim 1, wherein said elastic closed end loop members are contacted by yarn from the package nearing depletion at which stage the yarn follows an approximately vertical path.

* * * * *